US010287926B2

(12) United States Patent
Kim et al.

(10) Patent No.: US 10,287,926 B2
(45) Date of Patent: May 14, 2019

(54) SUPERCRITICAL CO2 GENERATION SYSTEM APPLYING RECUPERATOR PER EACH HEAT SOURCE

(71) Applicant: DOOSAN HEAVY INDUSTRIES & CONSTRUCTION CO., LTD., Changwon-si, Gyeongsangnam-do (KR)

(72) Inventors: Hak Soo Kim, Yongin-si (KR); Sang Hyeun Kim, Yongin-si (KR); Jun Tae Jang, Seoul (KR); Song Hun Cha, Osan-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 225 days.

(21) Appl. No.: 15/298,837

(22) Filed: Oct. 20, 2016

(65) Prior Publication Data

US 2017/0114673 A1 Apr. 27, 2017

(30) Foreign Application Priority Data

Oct. 21, 2015 (KR) ..... 10-2015-0146905

(51) Int. Cl.
*F01K 7/32* (2006.01)
*F01K 7/34* (2006.01)
(Continued)

(52) U.S. Cl.
CPC ..... *F01K 25/103* (2013.01); *F01K 7/32* (2013.01); *F01K 7/34* (2013.01); *F01K 7/38* (2013.01);
(Continued)

(58) Field of Classification Search
CPC ..... F01K 25/103; F01K 27/02; F01K 13/00; F01K 13/006; F01K 13/02; F01K 25/08;
(Continued)

(56) References Cited

U.S. PATENT DOCUMENTS 5,038,568 A * 8/1991 Gounder ..... F01K 7/22 60/663
9,359,919 B1 * 6/2016 Berry ..... F01K 25/106
(Continued)

FOREIGN PATENT DOCUMENTS

JP 06-42703 A 2/1994
JP 2008-157183 A 7/2008
KR 10-0613930 B1 8/2006

OTHER PUBLICATIONS

Communication dated Jul. 22, 2016, issued by the Korean Intellectual Property Office in corresponding Korean Application No. 10-2015-0146905.
(Continued)

*Primary Examiner* — Mark A Laurenzi
*Assistant Examiner* — Xiaoting Hu
(74) *Attorney, Agent, or Firm* — Invenstone Patent, LLC

(57) ABSTRACT

Disclosed herein is a supercritical $CO_2$ generation system using plural heat sources, including: a pump configured to circulate a working fluid; plural heat exchangers configured to heat the working fluid using an external heat source; plural turbines configured to be driven by the working fluid heated by passing through the heat exchanger; and plural recuperators configured to exchange heat between the working fluid passing through the turbine and the working fluid passing through the pump to cool the working fluid passing through the turbine and heat the working fluid passing through the pump, in which the heat exchanger may include plural constrained heat exchangers having an emission regulation condition of an outlet end and plural heat exchangers without the emission regulation condition.

14 Claims, 2 Drawing Sheets

(51) Int. Cl.

| | |
|---|---|
| ***F01K 7/38*** | (2006.01) |
| ***F22D 1/32*** | (2006.01) |
| ***F01K 13/00*** | (2006.01) |
| ***F01K 25/10*** | (2006.01) |

(52) U.S. Cl.
CPC ..... *F01K 13/00* (2013.01); *F01K 13/006* (2013.01); *F22D 1/32* (2013.01)

(58) Field of Classification Search
CPC ..... F01K 25/10; F01K 25/106; F01K 7/16; F01K 7/32; F01K 7/38; F01K 7/40; F01K 7/42; F01K 11/02; F22D 1/32
See application file for complete search history.

(56) References Cited

U.S. PATENT DOCUMENTS

| | | | | |
|---|---|---|---|---|
| 2006/0112692 | A1* | 6/2006 | Sundel | F01K 15/04 60/670 |
| 2012/0131920 | A1* | 5/2012 | Held | F01K 13/02 60/650 |
| 2014/0208750 | A1 | 7/2014 | Vermeersch et al. | |
| 2014/0298809 | A1* | 10/2014 | Sorida | F01K 7/18 60/643 |
| 2016/0003108 | A1* | 1/2016 | Held | F01K 23/10 60/517 |

OTHER PUBLICATIONS

International Search Report, issued by International Searching Authority in corresponding International Application No. PCT/KR2016/011512, dated Jan. 12, 2017.

* cited by examiner

[Fig. 1]
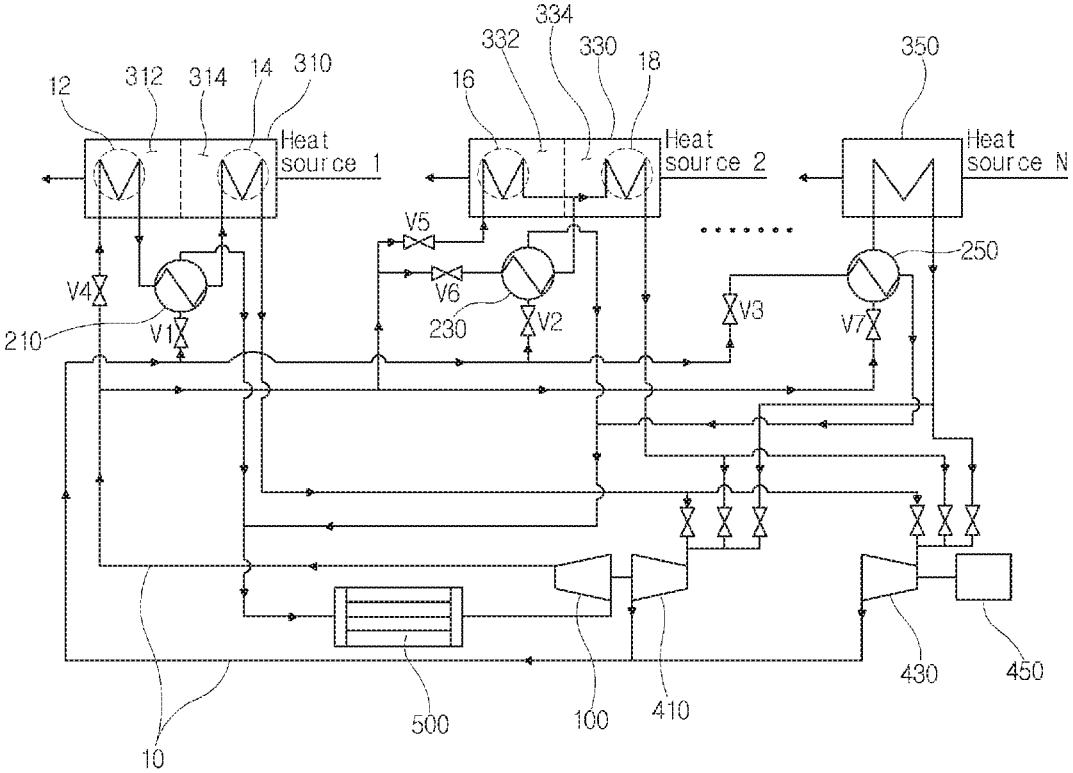

[Fig. 2]
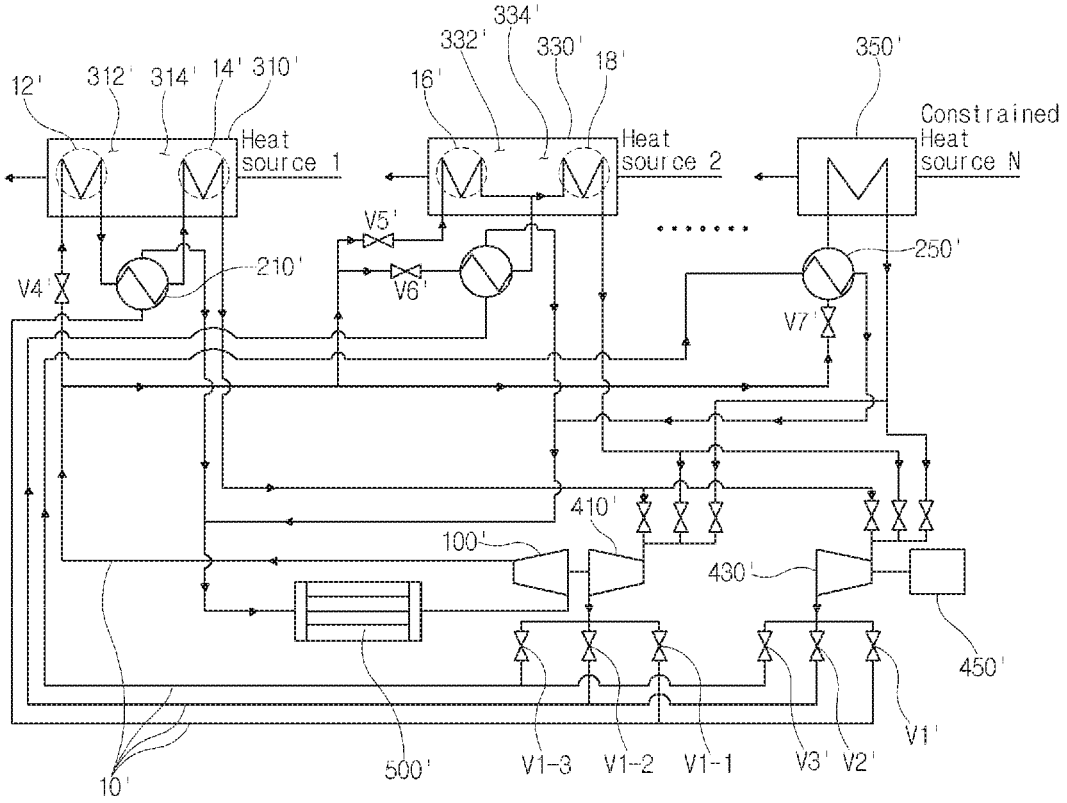

SUPERCRITICAL CO2 GENERATION SYSTEM APPLYING RECUPERATOR PER EACH HEAT SOURCE

CROSS-REFERENCE TO RELATED APPLICATION

This application claims priority to Korean Patent Application No. 10-2015-0146905, filed on Oct. 21, 2015, the disclosure of which is incorporated herein by reference in its entirety.

BACKGROUND OF THE INVENTION

Field of the Invention

Exemplary embodiments of the present invention relate to a supercritical $CO_2$ generation system, and more particularly, to a supercritical $CO_2$ generation system applying a recuperator per each heat source.

Description of the Related Art

As a necessity for efficient power production is increased internationally and activities for reducing the generation of pollutants are activated, various efforts to increase power production while reducing the generation of pollutants have been conducted. As one of the efforts, research and development for a power generation system using supercritical $CO_2$ as a working fluid as disclosed in Japanese Patent Laid-Open Publication No. 2012-145092 has been actively conducted.

The supercritical $CO_2$ has a density similar to a liquid state and viscosity similar to gas, such that apparatuses may be miniaturized and power consumption required to compress and circulate a fluid may be minimized. Meanwhile, the supercritical $CO_2$ having a critical point of 31.4° C. and 72.8 atmosphere are much lower than water having a critical point of 373.95° C. and 217.7 atmosphere and therefore may very easily be handled. The supercritical $CO_2$ generation system may show pure power generation efficiency of about 45% when being operated at 550° C. and have at least 20% increase in power generation efficiency compared to that of the existing steam cycle and reduce a size of a turbo apparatus to a level of 1: tens.

When plural heat sources having constraints is applied, the system configuration is complicated and it is difficult to effectively use heat, and as a result most of the supercritical $CO_2$ generation systems have one heater which is a heat source. Therefore, there is a problem in that the system configuration is restrictive and it is difficult to effectively use the heat source.

RELATED ART DOCUMENT

Patent Document (Patent Document 1) Japanese Patent Laid-open Publication No. 2012-145092 (Published on Aug. 2, 2012)

SUMMARY OF THE INVENTION

An object of the present invention is to provide a supercritical $CO_2$ generation system capable of effectively operating a system applying a recuperator per each heat source.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, there is provided a supercritical $CO_2$ generation system, including: a pump configured to circulate a working fluid; plural heat exchangers configured to heat the working fluid using an external heat source; plural turbines configured to be driven by the working fluid heated by passing through the heat exchanger; and plural recuperators configured to exchange heat between the working fluid passing through the turbine and the working fluid passing through the pump to cool the working fluid passing through the turbine and heat the working fluid passing through the pump, in which in at least one of the heat exchangers, an inlet end into which the external heat source is introduced is provided with a high temperature part and an outlet end to which the external heat source is discharged is provided with a low temperature part.

The supercritical $CO_2$ generation system may further include: a high-temperature transfer tube and a low-temperature transfer tube configured to supply the working fluid to the high temperature part and the low temperature part.

The number of recuperators may be equal to the number of heat exchangers.

The turbine may include a low temperature turbine driving the pump and a high temperature turbine driving a power generator and branch an integrated flux $mt_0$ of the working fluids passing through the low temperature turbine and the high temperature turbine and supply the integrated flux to the plural recuperators.

The heat exchanger may include first heat exchanger to third heat exchanger, the recuperator includes first to third recuperators, a front end of the pump may be provided with a cooler cooling the working fluid passing through the recuperator, and the first and second heat exchangers may include the high temperature part and the low temperature part.

The first recuperator may be disposed between the low-temperature transfer tube and the high-temperature transfer tube.

The second heat exchanger and the second recuperator may be disposed in parallel, the working fluids passing through the cooler and the pump may be branched to the first heat exchanger, the second heat exchanger, the second recuperator, and the third recuperator.

Some of the working fluid passing through the pump may be heated by sequentially passing through the low temperature part of the first heat exchanger, the first recuperator, and the high temperature part of the first heat exchanger to be supplied to the turbine.

Some of the working fluid passing through the pump may be branched to the low temperature part of the second heat exchanger and the second recuperator and the working fluid heated by passing through the second recuperator may be mixed with the working fluid heated by passing through the low temperature part of the second heat exchanger and heated by passing through the high temperature part of the second heat exchanger to be supplied to the turbine.

Some of the working fluid passing through the pump may be heated by the third recuperator and then heated by passing through the third heat exchanger to be supplied to the turbine.

The working fluid branched to the first to third recuperators by passing through the turbine may be cooled by the first to third recuperators to be introduced into the cooler.

In accordance with another aspect of the present invention, there is provided a supercritical $CO_2$ generation system, including: a pump configured to circulate a working fluid;

plural heat exchangers configured to heat the working fluid using an external heat source; a low temperature turbine and a high temperature turbine configured to be driven by the working fluid heated by passing through the heat exchanger, the low temperature turbine driving the pump and the high temperature turbine driving a power generator; plural recuperators configured to exchange heat between the working fluid passing through the low temperature turbine or the high temperature turbine and the working fluid passing through the pump to cool the working fluid passing through the low temperature turbine or the high temperature turbine and heat the working fluid passing through the pump; and plural control valves configured to be provided at outlet ends of the low temperature turbine and the high temperature turbine, respectively, to control a flux of the working fluid passing through the low temperature turbine or the high temperature turbine, in which in at least one of the heat exchangers, an inlet end into which the external heat source is introduced is provided with a high temperature part and an outlet end to which the external heat source is discharged is provided with a low temperature part.

The supercritical $CO_2$ generation system may further include: a high-temperature transfer tube and a low-temperature transfer tube configured to supply the working fluid to the high temperature part and the low temperature part.

The number of recuperators may be equal to the number of heat exchangers.

The transfer tubes of the working fluids at which the control valves provided at the outlet end of the low temperature turbine are installed may be connected to the transfer tubes of the working fluids at which the control valves provided at the outlet end of the high temperature turbine are installed.

The heat exchanger may include first heat exchanger to third heat exchanger, the recuperator may include first to third recuperators, a front end of the pump may be provided with a cooler cooling the working fluid passing through the recuperator, and the first and second heat exchangers may include the high temperature part and the low temperature part.

The first recuperator may be disposed between the low-temperature transfer tube and the high-temperature transfer tube.

The second heat exchanger and the second recuperator may be disposed in parallel, and the working fluids passing through the cooler and the pump may be branched to the first heat exchanger, the second heat exchanger, the second recuperator, and the third recuperator.

Some of the working fluid passing through the pump may be heated by sequentially passing through the low temperature part of the first heat exchanger, the first recuperator, and the high temperature part of the first heat exchanger to be supplied to the turbine, some of the working fluid passing through the pump may be branched to the low temperature part of the second heat exchanger and the second recuperator and the working fluid heated by passing through the second recuperator may be mixed with the working fluid heated by passing through the low temperature part of the second heat exchanger and heated by passing through the high temperature part of the second heat exchanger to be supplied to the turbine, and some of the working fluid passing through the pump may be heated by the third recuperator and then heated by passing through the third heat exchanger to be supplied to the turbine.

The working fluid branched to the first to third recuperators by passing through the turbine may be cooled by the first to third recuperators to be introduced into the cooler.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a schematic diagram illustrating a supercritical $CO_2$ generation system according to an exemplary embodiment of the present invention; and FIG. 2 is a schematic diagram illustrating a supercritical $CO_2$ generation system according to another exemplary embodiment of the present invention.

DESCRIPTION OF SPECIFIC EMBODIMENTS

Hereinafter, a supercritical $CO_2$ generation system applying plural heat sources according to an exemplary embodiment of the present invention will be described in detail with reference to the accompanying drawings.

Generally, the supercritical $CO_2$ generation system forms a closed cycle in which $CO_2$ used for power generation is not emitted to the outside and uses the supercritical $CO_2$ as a working fluid.

The supercritical $CO_2$ generation system uses the $CO_2$ as the working fluid and therefore may use exhaust gas emitted from a thermal power plant, etc., such that it may be used in a single generation system and a hybrid generation system with the thermal generation system. The working fluid of the supercritical $CO_2$ generation system may also supply $CO_2$ separated from the exhaust gas and may also supply separate $CO_2$.

The supercritical $CO_2$ (hereinafter, working fluid) within the cycle passes through a pump and then is heated while passing through a heat source such as a heater to be in a high temperature and pressure state, thereby driving a turbine. The turbine is connected to a power generator and the power generator is driven by the turbine to produce power. The working fluid used to produce power is cooled while passing through a heat exchanger and the cooled working fluid is again supplied to the pump and is circulated within the cycle. The turbine or the heat exchanger may be provided in plural.

The present invention proposes a supercritical $CO_2$ generation system which includes plural heaters using waste heat gas as a heat source and operates the recuperators equal to smaller than the number of heat sources by effectively disposing each heat exchanger depending on conditions such as temperature of an inlet and an outlet and capacity and the heat source and the number of heat sources.

The supercritical $CO_2$ generation system according to various exemplary embodiments of the present invention is used as a meaning including a system that all the working fluids flowing within the cycle are in the supercritical state and a system that most of the working fluids are in the supercritical state and the rest of the working fluids are in a subcritical state.

Further, according to various exemplary embodiments of the present invention, the $CO_2$ is used as the working fluid. Here, the $CO_2$ is used as a meaning including pure $CO_2$ in a chemical meaning, $CO_2$ somewhat including impurities in general terms, and a fluid in a state in which more than one fluid as additives is mixed with $CO_2$.

Further, in the exemplary embodiment of the present invention, the low temperature, the middle temperature, and the high temperature have a relative meaning and it is to be noted that that they are not understood as having the meaning that temperature higher than a specific temperature as a reference value is a high temperature and temperature lower than that is a low temperature.

FIG. 1 is a schematic diagram illustrating a supercritical $CO_2$ generation system according to an exemplary embodiment of the present invention.

As illustrated in FIG. 1, a supercritical $CO_2$ generation system according to an exemplary embodiment of the present invention may be configured to include a pump 100 configured to pass through the working fluid, plural recuperators and plural heat exchangers configured to exchange heat with the working fluid passing through the pump 100, plural turbines configured to be driven by the working fluid heated by passing through the recuperators and the heat exchangers, a power generator 450 configured to be driven by the turbines, and a cooler 500 configured to cool the working fluid introduced into the pump 100.

Fluxes of each of the working fluids passing through the plural turbines are merged into one (hereinafter, integrated flux) and then supplied to the recuperator or the heat exchanger.

Each of the components of the present invention is connected to each other by a transfer tube 10 through which the working fluid flows and unless specially mentioned, it is to be understood that the working fluid flows along the transfer tube 10. However, when plural components are integrated, the integrated configuration may include a part or an area actually serving as the transfer tube 10. Therefore, even in this case, it is to be understood that the working fluid flows along the transfer tube 10. A channel performing a separate function will be described additionally. A channel performing a separate function will be described additionally.

The pump 100 is driven by a low temperature turbine 410 to be described below and serves to transmit the low-temperature working fluid cooled by passing through the cooler 500 to the recuperator or the heater.

The recuperator exchanges heat between the working fluid cooled from the high temperature to the middle temperature while being expanded by passing through the turbine and the working fluid passing through the pump 100. The working fluid passing through the turbine is primarily cooled by the recuperator and the working fluid passing through the pump 100 is primarily heated by the recuperator. The recuperator is provided in plural and the cooling fluid passing through the turbine is appropriately distributed depending on driving conditions of the system and supplied. Inlet ends of each recuperator into which the cooling fluid passing through the turbine is introduced may be provided with control valves v1, v2, and v3. The working fluid primarily cooled by the recuperator is transferred to the cooler 500, secondarily cooled, and then transferred to the pump 100.

The working fluid transferred to the recuperator through the pump 100 exchanges heat with the working fluid passing through the turbine to be primarily heated and is supplied to the heat exchanger to be described below. Alternatively, the working fluid first passes through the heat source via the pump 100 and then passes through the recuperator. For this purpose, the inlet end of the transfer tube 10 into which the working fluid transferred from the pump 100 to the recuperator or the heat source is introduced may be provided with control valves v4 and v7. According to the exemplary embodiment of the present invention, the number of recuperators is equal to the number of heat sources, but the exemplary embodiment of the present invention will describe an example in which the recuperator is provided in three corresponding to the number of heat sources (this will be described below).

The heat exchanger heats the working fluid using the external heat source and is provided in plural. The present specification will describe an example in which a first heat exchanger 310 and a second heat exchanger 330 as a heat source without emission regulations and a third heat exchanger 350 as a heat source with emission regulations are provided. The meaning that there are the emission regulations stands for that there is a restrictive temperature upon the emission of waste heat gas.

The first heat exchanger 310 and the second heat exchanger 330 uses gas (hereinafter, waste heat gas) having waste heat like exhaust gas as the heat source and are a heat source without the emission regulations upon the emission of the waste heat gas. The first heat exchanger 310 and the second heat exchanger 330 exchanges heat between the waste heat gas and the working fluid to serve to heat the working fluid. The heat source without the emission regulation conditions may correspond to, for example, an AQC waste heat condition, etc.

In the first heat exchanger 310 and the second heat exchanger 330, an area of the inlet end into which the waste heat gas is introduced has a relatively higher temperature than an area of an outlet end to which the waste heat gas is discharged. A high temperature area is defined as high temperature parts 314 and 334 and a low temperature area is defined as low temperature parts 312 and 332 and the structure in which the working fluid is circulated via the low temperature parts 312 and 332 and the high temperature parts 314 and 334 of the first heat exchanger 310 and the second heat exchanger 330 is formed. The third heat exchanger 350 is the heat source with the emission regulations upon the emission of the waste heat gas. The waste heat gas from which the heat is taken away by the third heat exchanger 350 exchanges heat up to be cooled at a temperature meeting the emission regulation condition and then exits the third heat exchanger 350.

The disposition of the recuperator and the heat exchanger as described above will be described in more detail.

The first recuperator 210 is disposed between a low-temperature transfer tube 12 and a high-temperature transfer tube 14 passing through the low temperature part 312 and the high temperature part 314 of the first heat exchanger 310. Therefore, the working fluid passing through the pump 100 passes through the low temperature part 312 of the first heat exchanger 310 through the low-temperature transfer tube 12 and then is transferred to the first recuperator 210. The working fluid passes through the first recuperator 210, again passes through the high temperature part 314 of the first heat exchanger 310, and then is transferred to the turbine. In this case, the working fluid that is in the low temperature state by passing through the cooler 500 and the pump 100 is primarily heated while passing through the low temperature part 312 and secondarily heated by the first recuperator 210 by exchanging heat with the working fluid passing through the turbine. The working fluid passing through the turbine is in the middle temperature state that is a relatively higher temperature than the low-temperature working fluid passing through the cooler 500 and the pump 100. Next, the working fluid passing through the first recuperator 210 is tertiarily heated while passing through the high temperature part 314 of the first heat exchanger 310 to be in the high temperature state that may drive the turbine.

The second recuperator 230 is disposed in parallel with the second heat exchanger 3300 and some of the working fluid passing through the cooler 500 and the pump 100 is branched to be supplied to the second recuperator 230 and the second heat exchanger 300, respectively. The working fluid introduced into the second recuperator 230 exchanges heat with the working fluid passing through the turbine and then is supplied to the front end of the high temperature part 334 of the second heat exchanger 330. The working fluid introduced into the second recuperator 230 is primarily heated by the low temperature part 332 by passing through the low-temperature transfer tube 16 and then is mixed with the working fluid passing through the second recuperator 230 to be transferred to the high temperature part 334 through the high-temperature part transfer tube 18. The working fluid heated by the high temperature part 334 is in the high temperature state that may drive the turbine to be supplied to the turbine. In this case, the working fluid that is in the low temperature state by passing through the pump 100 exchanges heat with the working fluid passing through the turbine by the second recuperator 230 to be heated. The working fluid passing through the turbine is in the middle state having a relatively higher temperature than the low-temperature working fluid passing through the pump 100, and therefore the heat exchange may be made. Next, the working fluid cooled while passing through the turbine and the second recuperator 230 is again transferred to the cooler 500 to be cooled.

The third recuperator 250 is introduced with some of the working fluid passing through the turbine and the working fluid passing through the turbine exchanges heat with the low-temperature working fluid passing through the pump 100 to be primarily cooled. Next, the cooled working fluid is transferred to the cooler 500 to be cooled. The working fluid passing through the turbine is in the middle state having a relatively higher temperature than the low-temperature working fluid passing through the pump 100, and therefore may exchange heat with the working fluid passing through the pump 100. The working fluid passing through the pump 100 exchanges heat by the third recuperator 250 to be primarily heated and is secondarily heated by the third heat exchanger 350 using the heat of the waste heat gas. The working fluid that is in the high temperature state by being heated by the third heat exchanger 350 is in the high temperature that may operate the turbine to be supplied to the turbine.

The foregoing turbine is configured to include a low temperature turbine 410 and a high temperature turbine 430 and is driven by the working fluid. At least one of the turbines is connected to a power generator 450 and the generator is driven by the turbine to produce power. The working fluid is expanded while passing through the low temperature turbine 410 and the high temperature turbine 430, and therefore the turbines 410 and 430 also serves as an expander. According to the exemplary embodiment of the present invention, the high temperature turbine 430 is connected to the high temperature turbine 430 to produce power and the low temperature turbine 410 serves to drive the pump 100.

Here, the terms low temperature and high temperature have a relative meaning and it is to be noted that that they are not understood as having the meaning that temperature higher than a specific temperature as a reference value is a high temperature and temperature lower than that is a low temperature.

In the supercritical $CO_2$ generation system according to the exemplary embodiment of the present invention having the above configuration, the detailed example of the flow of the working fluid will be described as follows.

The working fluid cooled by passing through the cooler 500 is circulated by the pump 100 to be branched to the first heat exchanger 310, the second heat exchanger 330, the second recuperator 230, and the third recuperator 250 respectively, through the control valves v4 to v7. Further, the flux in which the working fluids passing through the low temperature turbine 410 and the high temperature turbine 430 are mixed with each other is branched to the first to third recuperators 210, 230, and 240, respectively, through the control valves v1 to v3. The working fluid primarily cooled by the first to third recuperators 210, 230, and 250 by passing through the turbine is transferred to the cooler 500. The amount of working fluid transferred to the recuperator or the heat exchanger, respectively, may be adjusted depending on the temperature or capacity of the waste heat gas, the presence and absence of the constrained conditions, the extent of the constrained conditions, the operation conditions of the system, or the like. The working fluid is distributed by controlling open values of the control valves v1 to v7 using a separate controller.

The low-temperature working fluid introduced into the first heat exchanger 310 is introduced into the low temperature part 312 of the first heat exchanger through the low-temperature transfer tube 12 and thus is primarily heated by the heat of the waste heat gas. Next, the working fluid is transferred to the first recuperator 210 and exchanges heat with the working fluids passing through the low temperature turbine 410 and the high temperature turbine 430 to be secondarily heated. The working fluid secondarily heated is again introduced into the high temperature part 314 of the first heat exchanger 310 through the high-temperature transfer unit 14 and is tertiarily heated by the heat of the waste heat gas and then is transferred to the low temperature turbine 410 or the high temperature turbine 430.

Meanwhile, the low-temperature working fluid is branched to the second heat exchanger 330 and the second recuperator 230, respectively, to be introduced. The low-temperature working fluid branched to the second heat exchanger 330 is primarily heated by the low temperature part 332 using the heat of the waste heat gas through the low-temperature transfer tube 16. Next, the working fluid primarily heated is mixed with the working fluid passing through the second recuperator 230. The mixed working fluid is introduced into the high temperature part 334 by the high-temperature transfer tube 18 of the second heat exchanger 330 to be secondarily heated by the heat of the waste heat gas, and then is transferred to the low temperature turbine 410 or the high temperature turbine 430. Further, the low-temperature working fluid branched to the second recuperator 230 exchanges heat with the working fluid passing through the turbine to be primarily heated. Next, it is transferred between the low temperature part 332 and the high temperature part 334 to be mixed with the working fluid passing through the low temperature part 332.

The working fluid introduced into the third recuperator 250 passes through the turbine to be exchange heat with the working fluid introduced into the third recuperator 250 to thereby be primarily heated. The working fluid primarily heated is introduced into the third heat exchanger 350 to be secondarily heated by the heat of the waste heat gas and then is transferred to the low temperature turbine 410 or the high temperature turbine 430.

The working fluids passing through the low temperature turbine 410 and the high temperature turbine 430 have a relatively higher temperature than the working fluid passing through the pump 100 and are a relatively lower temperature than the working fluid introduced into the low temperature turbine 410 and the high temperature turbine 430. If the temperature of the working fluid passing through the pump 100 is the low temperature, the working fluids passing through the low temperature turbine 410 and the high temperature turbine 430 correspond to the middle temperature. The working fluid introduced into the low temperature turbine 410 and the high temperature turbine 430 corresponds to a relatively high temperature (here, low temperature, middle temperature, and high temperature are a relative concept).

It is determined by the foregoing controller how much working fluid is transferred to any of the low temperature turbine 410 and the high temperature turbine 430.

Generally, the output of the high temperature turbine 430 driving the power generator 450 is larger than that of the low temperature turbine 410 driving the pump 100, and therefore when the working fluid is discharged from the first to third heat exchangers 310, 330, and 350, it is preferable to transfer the working fluid that is the relatively high temperature to the high temperature turbine 430. However, the distribution of the working fluid may be changed depending on the operation conditions of the system.

Hereinabove, the exemplary embodiment in which the integrated flux of the working fluids of the low temperature turbine and the high temperature turbine is branched to be transferred to the first to third recuperators is described, but the fluxes of each of the low temperature turbine and the high temperature turbine may be selectively distributed (the detailed description of the same configuration as the foregoing exemplary embodiment will be omitted).

FIG. 2 is a schematic diagram illustrating a supercritical $CO_2$ generation system according to another exemplary embodiment of the present invention.

As illustrated in FIG. 2, outlet ends of a low temperature turbine 410' and a high temperature turbine 430' may be provided with plural control valves v1', v2', v3', v1-1, v1-2, and v1-3.

A working fluid cooled by passing through a cooler 500' is circulated by a pump 100' to be transferred while being branched to a first heat exchanger 310', a second heat exchanger 330', a second recuperator 230', and a third recuperator 250', respectively, through the control valves v4 to v7. Further, a flux of a working fluid passing through the high temperature turbine 430' is transferred while being branched to the first to third recuperators 210', 230', and 250', respectively, through control valves v1' to v3'. The flux of the working fluid passing through the low temperature turbine 410' is controlled by the control valves v1-1, v1-2, and v1-3, such that the working fluid passing through the low temperature turbine 410' may be mixed or may not be mixed with the working fluid passing through the high temperature turbine 430'.

Describing in more detail, transfer tubes at which the control valves v1-1, v1-2, and v1-3 provided at an outlet end of the low temperature turbine 410' are installed are connected to the transfer tubes transferring the working fluids passing through the control valves v1' to v3' provided at the outlet end of the high temperature turbine 430'. Therefore, the working fluid passing through the low temperature turbine 410' may be distributed to three transfer tubes. The distributed working fluid may be mixed or may not be mixed with working fluids, respectively, passing through each of the control valves v1' to v3' and if mixed, the flux thereof may be controlled.

At how much flux the working fluid passing through the low temperature turbine 410' and the working fluid passing through the high temperature turbine 430' are mixed with each other and the distribution amount of the working fluid passing through the high temperature turbine 430' may be changed depending on the operation conditions of the system. The working fluid with which the working fluid passing through the high temperature turbine 430' or the working fluid passing through the low temperature turbine 410' is mixed is primarily cooled by first to third recuperators 210', 230' and 250'. The working fluid primarily cooled is transferred to the cooler 500'.

The supercritical $CO_2$ generation system according to the exemplary embodiment of the present invention may use the recuperator per each heat source to effectively use the plural heat sources, such that the configuration of the system may be simplified and the operation of the system may be simplified. As a result, the configuration costs of the system may be reduced and the system may be effectively operated. Further, the system may be widely applied to the plural heat sources having various conditions and therefore the utilization of the system may be increased.

The various exemplary embodiments of the present invention, which is described as above and shown in the drawings, should not be interpreted as limiting the technical spirit of the present invention. The scope of the present invention is limited only by matters set forth in the claims and those skilled in the art can modify and change the technical subjects of the present invention in various forms. Therefore, as long as these improvements and changes are apparent to those skilled in the art, they are included in the protective scope of the present invention.

What is claimed is:

1. A supercritical $CO_2$ generation system, comprising:

a pump configured to circulate a working fluid;

plural heat exchangers configured to heat the working fluid using an external heat source;

plural turbines configured to be driven by the working fluid heated by passing through the heat exchangers;

plural recuperators configured to exchange heat between the working fluid passing through the turbines and the working fluid passing through the pump to cool the working fluid passing through the turbines and heat the working fluid passing through the pump, wherein in at least one of the heat exchangers, an inlet end into which the external heat source is introduced is provided with a high temperature part and an outlet end to which the external heat source is discharged is provided with a low temperature part; and a high-temperature transfer tube and a low-temperature transfer tube configured to supply the working fluid to the high temperature part and the low temperature part;

wherein the heat exchangers include first, second, and third heat exchangers, the recuperators include first, second, and third recuperators, and the first and second heat exchangers include the high temperature part and the low temperature part, wherein the first recuperator is disposed between the low-temperature transfer tube and the high-temperature transfer tube of the first heat exchanger, and wherein the second heat exchanger and the second recuperator are disposed in parallel, and the working fluid passing through the pump is branched to the first heat exchanger, the second heat exchanger, the second recuperator, and the third recuperator.

2. The supercritical $CO_2$ generation system of claim 1, wherein the number of recuperators is equal to the number of heat exchangers.

3. The supercritical $CO_2$ generation system of claim 1, wherein the turbines include a low temperature turbine driving the pump and a high temperature turbine driving a power generator and an integrated flux $mt_0$ of the working fluids passing through the low temperature turbine and the high temperature turbine is branched to be supplied to the plural recuperators.

4. The supercritical $CO_2$ generation system of claim 3, wherein a front end of the pump is provided with a cooler cooling the working fluid passing through the recuperators.

5. The supercritical $CO_2$ generation system of claim 4, wherein some of the working fluid passing through the pump is heated by sequentially passing through the low temperature part of the first heat exchanger, the first recuperator, and the high temperature part of the first heat exchanger to be supplied to the turbines.

6. The supercritical $CO_2$ generation system of claim 5, wherein some of the working fluid passing through the pump is branched to the low temperature part of the second heat exchanger and the second recuperator and the working fluid heated by passing through the second recuperator is mixed with the working fluid heated by passing through the low temperature part of the second heat exchanger and heated by passing through the high temperature part of the second heat exchanger to be supplied to the turbines.

7. The supercritical $CO_2$ generation system of claim 6, wherein some of the working fluid passing through the pump is heated by the third recuperator and then heated by passing through the third heat exchanger to be supplied to the turbines.

8. The supercritical $CO_2$ generation system of claim 7, wherein the working fluid branched to the first, second, and third recuperators by passing through the turbines is cooled by the first, second, and third recuperators to be introduced into the cooler.

9. A supercritical $CO_2$ generation system, comprising:

a pump configured to circulate a working fluid;

plural heat exchangers configured to heat the working fluid using an external heat source;

a low temperature turbine and a high temperature turbine configured to be driven by the working fluid heated by passing through the heat exchangers, the low temperature turbine driving the pump and the high temperature turbine driving a power generator;

plural recuperators configured to exchange heat between the working fluid passing through the low temperature turbine or the high temperature turbine and the working fluid passing through the pump to cool the working fluid passing through the low temperature turbine or the high temperature turbine and heat the working fluid passing through the pump;

plural control valves configured to be provided at outlet ends of the low temperature turbine and the high temperature turbine, respectively, to control a flux of the working fluid passing through the low temperature turbine or the high temperature turbine, wherein in at least one of the heat exchangers, an inlet end into which the external heat source is introduced is provided with a high temperature part and an outlet end to which the external heat source is discharged is provided with a low temperature part; and a high-temperature transfer tube and a low-temperature transfer tube configured to supply the working fluid to the high temperature part and the low temperature part, wherein the heat exchangers include first, second, and third heat exchangers, the recuperators include first, second, and third recuperators and the first and second heat exchangers include the high temperature part and the low temperature part, wherein the first recuperator is disposed between the low-temperature transfer tube and the high-temperature transfer tube of the first heat exchanger, and wherein the second heat exchanger and the second recuperator are disposed in parallel, and the working fluid passing through the pump is branched to the first heat exchanger, the second heat exchanger, the second recuperator, and the third recuperator.

10. The supercritical $CO_2$ generation system of claim 9, wherein the number of recuperators is equal to the number of heat exchangers.

11. The supercritical $CO_2$ generation system of claim 10, wherein the transfer tubes of the working fluids at which the control valves provided at the outlet end of the low temperature turbine are installed are connected to the transfer tubes of the working fluids at which the control valves provided at the outlet end of the high temperature turbine are installed.

12. The supercritical $CO_2$ generation system of claim 11, wherein a front end of the pump is provided with a cooler cooling the working fluid passing through the recuperators.

13. The supercritical $CO_2$ generation system of claim 12, wherein some of the working fluid passing through the pump is heated by sequentially passing through the low temperature part of the first heat exchanger, the first recuperator, and the high temperature part of the first heat exchanger to be supplied to the turbines, some of the working fluid passing through the pump is branched to the low temperature part of the second heat exchanger and the second recuperator and the working fluid heated by passing through the second recuperator is mixed with the working fluid heated by passing through the low temperature part of the second heat exchanger and heated by passing through the high temperature part of the second heat exchanger to be supplied to the turbines, and some of the working fluid passing through the pump is heated by the third recuperator and then heated by passing through the third heat exchanger to be supplied to the turbines.

14. The supercritical $CO_2$ generation system of claim 13, wherein the working fluid branched to the first, second, and third recuperators by passing through the turbines is cooled by the first, second, and third recuperators to be introduced into the cooler.

* * * * *